United States Patent [19]

Hirose

[11] 4,097,931

[45] Jul. 4, 1978

[54] FINGER PROTECTION USABLE FOR ARCHERY

[75] Inventor: Akira Hirose, Hamamatsu, Japan

[73] Assignee: Nippon Gakki Seizo Kabushiki Kaisha, Japan

[21] Appl. No.: 691,973

[22] Filed: Jun. 2, 1976

[30] Foreign Application Priority Data

Jun. 18, 1975 [JP] Japan ..... 50-82912[U]

[51] Int. Cl.$^2$ ..... A41D 13/08

[52] U.S. Cl. ..... 2/21

[58] Field of Search ..... 2/21, 163, 167; 294/25; 124/35 A

[56] References Cited

U.S. PATENT DOCUMENTS

| | | | |
|---|---|---|---|
| 2,834,018 | 5/1958 | Farmes | 2/21 |
| 2,999,243 | 9/1961 | Gross et al. | 2/21 |
| 3,028,852 | 4/1962 | Sutton, Jr. | 124/35 A |
| 3,224,009 | 12/1965 | Hoyt, Jr. | 2/21 |
| 3,246,338 | 4/1966 | Miller | 2/21 |
| 3,845,504 | 11/1974 | Killian | 2/21 |

FOREIGN PATENT DOCUMENTS

| | | | |
|---|---|---|---|
| 626,306 | 8/1961 | Canada | 124/35 A |

*Primary Examiner*—Werner H. Schroeder
*Assistant Examiner*—Moshe I. Cohen
*Attorney, Agent, or Firm*—Ostrolenk, Faber, Gerb & Soffen

[57] ABSTRACT

Finger protection such as finger tabs and gloves for use in archery is provided with one or more raised strips at a portion or portions corresponding to the first joint or joints of the middle and/or ring fingers, pull of the string being facilitated by engaging same with one of the sides of the raised strips.

14 Claims, 5 Drawing Figures

FINGER PROTECTION USABLE FOR ARCHERY

BACKGROUND OF THE INVENTION

The present invention relates to finger protection usable for archery, and more particularly relates to finger protection such as finger tabs and gloves which facilitates the pulling of the bowstring.

Finger protection made of leather or other suitable materials is in general used for protecting archer's fingers which come into contact with the bowstring. Conventionally, however, as finger protection, e.g. a finger tab is just simply attached to the fingers, undesirable slippage tends to take place between the finger tab and the bowstring, thereby making it very difficult to hold the bowstring at a contact position on the fingers. Therefore, just like in the case of holding the bowstring without such a finger tab, holding of the bowstring is dependent upon bending of the fingers only. This manner of bowstring holding causes considerable fatigue on the fingers after repeated use, for example, in competition, as the tension on bowstrings is in general very great. This fatigue on fingers may cause increased failure in hitting targets successfully.

BRIEF DESCRIPTION AND OBJECTS OF THE INVENTION

It is the primary object of the present invention to provide finger protection usable for archery which assure stable holding of the bowstrings.

It is another object of the present invention to provide finger protection usable for archery which, when the string is pulled, greatly reduces the load on the archer's fingers and minimizes fatigue on fingers even after repeated use.

Still another object of the present invention is to provide finger protection usable for archery which enables smooth release of the bowstrings.

It is a further object of the present invention to provide finger protection usable for archery which assures high rate of successful hitting of targets.

In accordance with the present invention, the finger protection has a protector strip of a relatively soft, resilient and humidity absorptive material and of a pattern adapted to cover almost the entire area of archer's fingers except for the thumb and the little finger. This protecting strip can be detachably fixed to the archer's fingers or hands via a fastener band affixed thereto. One or more raised portions or strips are provided on the surface of the protecting strip corresponding to the first joints of the middle and/or ring fingers.

BRIEF SUMMARY OF THE INVENTION

The finger protector of the present invention includes a finger protecting strip adapted to cover portions of the middle, ring and index fingers of an archer's hand. A raised bowstring engaging section projects from the finger protecting strip at a location corresponding generally to the first joint of the middle finger of the archer's hand. The raised section has a width no greater than the width of the middle finger of the archer's hand and a length no greater than one half its width. If desired, a second raised bowstring engaging section, projecting from the finger protecting strip and positioned at a location corresponding generally to the first joint of the ring finger of the archer's hand, may be provided. The second raised bowstring engaging section has a width no greater than the width of the ring finger of the archer's hand and a length no greater than one half of its width. Preferably, the bowstring engaging edge of both the first and second raised sections are located directly adjacent the first joint of the middle and ring fingers, respectively.

In a second embodiment of the present invention, a second finger protecting strip is coupled to the first protecting strip and covers each of the raised bowstring engaging sections thereof. The second finger protecting strip is flexible in order that it may conform to the general configuration of the raised bowstring engaging sections when the finger protector is brought into operational engagement with the bowstring.

BRIEF DESCRIPTION OF THE FIGURES

Further features and advantages of the present invention will be made clearer from the ensuing description, reference being made to the embodiments shown in the accompanying drawings, in which.

DETAILED DESCRIPTION OF THE INVENTION

Figure 1:
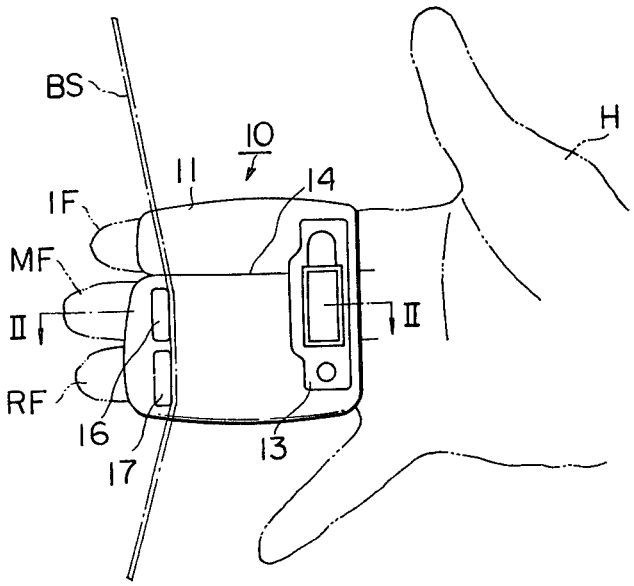
FIG. 1 is a side plan view of an embodiment of the finger protection in accordance with the present invention with fingers being shown with two-dots and chain lines and the bowstring with dot-and chain lines.
Figure 2:
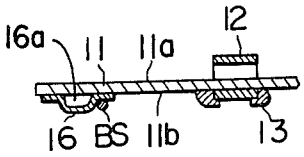
FIG. 2 is a section taken along the lines II—II in FIG. 1.

Referring to FIGS. 1 and 2, a protection, e.g. a finger tab 10 has a finger protecting strip 11 made of a relatively soft, resilient and humidity absorptive material such as a leather called cordovan skin and having a pattern which covers almost the entire area of the index, middle and ring fingers IF, MF and RF.

On the finger side 11*a*, i.e. the side facing the fingers during use, the strip 11 is provided with a fastener band 12 into which the middle finger MF should be inserted in order to fix the tab 10 to the archer's hand H for operating the bowstring BS. This fastener band 12 is bound to the strip 11 via a band holder 13 provided on the bowstring side 11*b*, i.e. the side facing the bowstring BS during the use of the strip 11. At a portion bordering the index and middle fingers IF, MF, the strip 11 is provided with a slit 14 running in the lengthwise direction of the finger IF and extending to the position whereat the band holder 13 is provided. The slit 14 facilitates the smooth following movement of the strip to the finger's action.

The protecting strip 11 is further provided with a pair of raised sections or strips 16 and 17 on the bowstring side 11*b* at positions corresponding to the first joints of the middle and ring fingers MF, RF when the finger tab 10 is carried by the archer's hand H. These raised sections or strips 16 and 17 may be made of leather alone or of a combination of leather with other material or materials such as plastic, wood and the horn of buffaloes. Each raised strip of leather is sewn to the finger protecting strip 11. When the above-described other material is to be added, the selected material is inserted in the opening 16*a* formed between the two members 11 and 16. Preferably, the height of the raised section 16 or 17 is in a range between 1 and 2 mm. whereas the thickness of the finger protecting strip 11 is about 1 mm. These raised sections 16 and 17 are adapted for holding and pulling the bowstring BS as shown in FIG. 1.

In use, the finger tab 10 in accordance with the present invention is fixed to the hand H by inserting the fastener band 12 over the middle finger MF of the archer so that the tab 10 covers almost the entire area of the fingers, except for the thumb and the little finger, for protective purposes. In shooting an arrow, the bowstring BS is pulled by the two fingers MF and RF of the archer whereupon the bowstring BS is engaged with the raised sections 16 and 17 on one side thereof as clearly seen in FIGS. 1 and 2. The raised sections 16 and 17 are arranged at the positions of the first joints of the middle and ring fingers MF, RF, whereby the holding position of the bowstring BS is always well maintained at a constant position. Thus, it is not necessary to bend the fingers too much in order to hold the bowstring stably and this reduced load mitigates the fatigue on the fingers.

Figure 3:
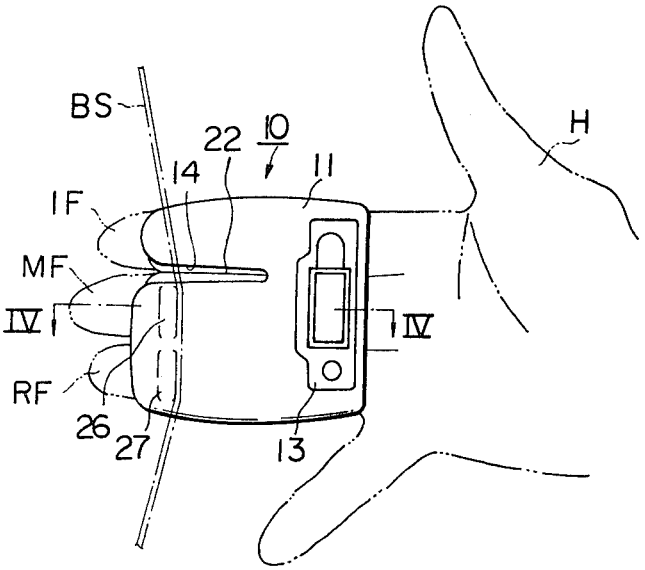
FIG. 3 is a side plan view of another embodiment of the finger protection in accordance with the present invention.
Figure 4:
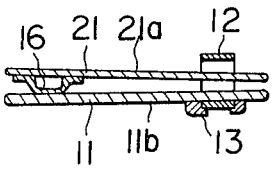
FIG. 4 is a section taken along the line IV—IV in FIG. 3 in an inoperative disposition.
Figure 5:
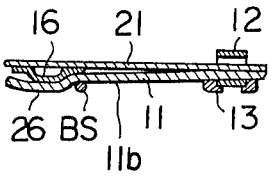
FIG. 5 is a same section with that shown in FIG. 4 in an operative disposition.

Another embodiment of the finger tab in accordance with the present invention is shown in FIGS. 3–5, in which elements common to those in the embodiment shown in FIGS. 1 and 2 are indicated with common reference numerals.

In FIGS. 3 and 4, the finger tab 10 has an additional finger protecting strip 21 which is made of a thinner, more pliant and softer leather material than that used for the protecting strip 11. The shape of this additional protector strip 21 is patterned after that of the main protector strip 11 and a slit 22 is formed at a position corresponding to the position of the slit 14 of the main protecting strip 11. The additional protecting strip 21 is coupled to the main protecting strip 11 by the fastener band 12 or other suitable means in surface contact with each other. In this case, the raised section or strips 16 and 17 are arranged on the side of the additional protecting strip 21 facing the main strip. The positions of these raised sections 16 and 17 correspond to the first joints of the middle and ring fingers MF and RF. They may be made of a material similar to those used in the first embodiment.

In use, the middle finger MF is inserted into the fastener band 12 and the other fingers IF, MF and RF come in contact with the finger side 21*a* of the additional protecting strip 21.

In the inoperative disposition shown in FIG. 4, the strips 11 and 21 are coupled to each other in a loose state. Whereas, in the operative disposition shown in FIG. 5, they are brought into a snug pressure contact with each other and a pair of raised portions 26, 27 are developed on the bowstring side 11 of the strip 11 at positions corresponding to those of raised sections 16, 17 on the protecting strip 21. Similarly, they are used for holding the bowstring BS when the latter is pulled by hand.

Use of the additional protecting strip 11 eases holding of the bowstring BS and assures smooth release of the bowstring BS and protection of the raised sections 16, 17.

In the case of the illustrated embodiments, the raised sections or strips 16 and 17 are made separate from the protecting strips 11 or 21, though fixed thereto. However, they may be made integral, as one piece, of the body of the protecting strips 11 or 21. Although a pair of raised sections or strips are arranged at positions corresponding to the middle and ring fingers in the illustrated embodiments, only one raised section or strip need be arranged at a position corresponding to the middle finger.

As is clear from the foregoing description, provision of the raised section or sections on the protecting strip assures remarkable stability in the holding position of the bowstring with greatly reduced load on the fingers when the bowstring is to be pulled. Further, use of the additional protecting strip eases holding of the bowstring and assures smooth release of the bowstring and effectively protects the raised section or sections.

All references to the "width" of raised bowstring engaging sections 16 and 17 in the following claims refer to the dimension of these elements measured along a line extending from the top to the bottom of FIG. 1. All references to the "length" of raised bowstring engaging sections 16 and 17 in the following claims refer to the dimension of these elements measured along a line extending from the left to the right hand side of FIG. 1.

What is claimed is:

1. A finger protector for use in archery, comprising:

a finger protecting strip adapted to cover portions of the middle, ring and index fingers of an archer's hand;

a raised bowstring engaging section projecting from said strip and positioned at a location corresponding generally to the first joint of the middle finger of the archer's hand, said raised section having a width equal to or less than the width of the middle finger of the average archer's hand, said raised section also having a length no greater than its width.

2. A finger protector as claimed in claim 1 in which said finger protecting strip is made of leather.

3. A finger protector as claimed in claim 2 in which said raised section is made of leather.

4. A finger protector as claimed in claim 1 in which the height of said raised section is in a range from 1 to 2 mm.

5. A finger protector as claimed in claim 2 in which said raised section is made of a combination of leather with other material or materials.

6. Finger protection as claimed in claim 5 in which said other material or materials are chosen from a group composed of plastic, wood and horn of buffaloes.

7. A finger protector as claimed in claim 2 in which the thickness of said finger protecting strip is about 1 mm.

8. A finger protector as claimed in claim 1 in which said raised section is integrally formed with said finger protecting strip.

9. A finger protector as claimed in claim 1 wherein the bowstring engaging edge of said raised section is located directly adjacent the first joint of the middle finger of the archer's hand.

10. A finger protector as claimed in claim 1 further including a second raised bowstring engaging section projecting from said finger protecting strip and positioned at a location corresponding generally to the first joint of the ring finger of the archer's hand, said second raised section having a width no greater than the width of the ring finger of the archer's hand, said second raised section also having a length no greater than its width.

11. The finger protector of claim 10 further including a second finger protecting strip coupled to said first finger protecting strip and covering said first and second bowstring engaging sections, said second finger protecting strip being flexible in order that it may conform to the general configuration of the bowstring engaging edges of said first and second raised bowstring engaging sections when the finger protector is brought into operational engagement with a bowstring.

12. The finger protector strip of claim 11 wherein said first finger protecting strip is made of a thinner, more pliant and softer material than that used for said second finger protecting strip.

13. The finger protector strip of claim 11 wherein the bowstring engaging edges of said first and second raised sections are located directly adjacent the first joint of said middle finger of said archer's hand.

14. A finger protector for use in archery, comprising:

a finger protecting strip adapted to cover portions of the middle, ring and index fingers of an archer's hand;

a raised bowstring engaging section projecting from said strip and positioned at a location corresponding generally to the first joint of the ring finger of the archer's hand, said raised section having a width equal to or less than the width of the middle finger of the average archer's hand, said raised section also having a length no greater than its width.

* * * * *